US006962507B2

(12) United States Patent
Suess

(10) Patent No.: US 6,962,507 B2
(45) Date of Patent: Nov. 8, 2005

(54) CONNECTION SYSTEM

(75) Inventor: Christian Suess, Strullendorf (DE)

(73) Assignee: Wieland Electric GmbH, Bamberg (DE)

( * ) Notice: Subject to any disclaimer, the term of this patent is extended or adjusted under 35 U.S.C. 154(b) by 51 days.

(21) Appl. No.: 10/424,346

(22) Filed: Apr. 28, 2003

(65) Prior Publication Data

US 2003/0203671 A1 Oct. 30, 2003

(30) Foreign Application Priority Data

Apr. 26, 2002 (DE) ..... 102 18 567

(51) Int. Cl.[7] ..... H01R 13/60
(52) U.S. Cl. ..... 439/532
(58) Field of Search ..... 439/532, 716, 439/409, 391, 410, 432, 433, 434, 447, 393, 387, 389

(56) References Cited

U.S. PATENT DOCUMENTS

| | | | |
|---|---|---|---|
| 4,171,861 | A | 10/1979 | Hohorst |
| 5,334,054 | A | 8/1994 | Conrad et al. |
| 5,480,310 | A | 1/1996 | Baum |
| 5,928,008 | A | 7/1999 | Munshi |
| 6,471,552 | B2 | 10/2002 | Bechaz et al. |

FOREIGN PATENT DOCUMENTS

| | | |
|---|---|---|
| CH | 628 467 | 2/1982 |
| DE | GM 77 12 331 | 11/1977 |
| DE | 196 17 114 C2 | 10/1997 |
| DE | 197 08 911 C1 | 7/1998 |
| DE | 199 60 838 A1 | 7/2001 |
| EP | 0 554 519 B1 | 8/1993 |

*Primary Examiner*—Ross Gushi
*Assistant Examiner*—Phuongchi Nguyen
(74) *Attorney, Agent, or Firm*—Laurence A. Greenber; Werner H. Stemer; Ralph E. Locher

(57) ABSTRACT

A connection system includes a current bar, a contact foot, a clamping element, and a bearing bar with an edge, behind which the clamping element reaches, the contact foot is held at the current bar by a resilient clamp connection for simplifying production.

11 Claims, 4 Drawing Sheets

CONNECTION SYSTEM

BACKGROUND OF THE INVENTION

Field of the Invention

The invention relates to a connection system with a current bar and a contact foot and with a clamping element and a bearing bar with an edge, whereby the clamping element reaches behind the bearing bar edge and fixes the contact foot at the bearing bar.

A connection system, disclosed in European Patent 0 554 519 B1, corresponding to U.S. Pat. No. 5,334,054 to Conrad et al., for example, is usually part of a protective conductor terminal or a ground conductor terminal that serves for producing a conductive connection between one or more electrical conductors and a protective conductor busbar. To that end, a conductor bar with conductor terminals and a connection system including a mounting foot or contact foot, which is connected to the current bar, are installed in an insulating housing of the protective conductor series terminal or ground series terminal. The metallic mounting foot connects the current bar to the protective conductor busbar, also referred to as a bearing bar or cap bar.

In this prior art connection system, the contact foot and current bar are contacted by a fixed mechanical and, therefore, permanent, connection, for instance, by a weld, solder, or rivet joint between the contact foot and the current bar as according to the German Utility model G 77 12 331 U1, corresponding to U.S. Pat. No. 4,171,861 to Hohorst. Additional assembly devices are needed in order to produce these permanent connections, which leads to an unwanted production expenditure in the assembly of the connection system and thus the assembly of the protective conductor terminal.

SUMMARY OF THE INVENTION

It is accordingly an object of the invention to provide a connection system that overcomes the hereinaforementioned disadvantages of the heretofore-known devices of this general type and that simplifies a connection system of the above type with respect to production.

With the foregoing and other objects in view, there is provided, in accordance with the invention, a connection system, including a current bar, a contact foot, a clamping element, a bearing bar having a bearing bar edge, the clamping element extending behind the bearing bar edge and removably fixing the contact foot at the bearing bar, and the contact foot being contacted at the current bar in a resilient clamp connection.

The connection between the contact foot and the current bar of the connection system is constructed as a resilient clamp connection. In such a context, resilient clamp connection also encompasses a catch mechanism whose spring action guarantees not only a secure mechanical retention or fixing but also a reliable electrical contact between the contact foot and the current bar. The clamp connection can be advantageously unmade.

The invention is based on the idea that such a connection system can be simplified with respect to production if the interconnection among its individual parts is achieved simply by putting the parts together. To ensure reliable conductive contact as well as mechanical stability, gaps in the connection between the current bar and the contact foot, which may arise as a result of production tolerances, for example, should be avoided or at least compensated. Such compensation can be easily and reliably achieved by placing at least one of the relevant parts in the connection under a certain initial mechanical tension.

The resilient clamp connection, thus, enables easy assembling of the mounting foot and the current bar without additional assembly devices, and, on the other hand, it enables reliable contacting of the contact foot to the current bar, and, therefore, makes possible a durable electrical current.

In accordance with another feature of the invention, two contact legs are provided, at least one of which is resilient. According to a first variant, both the first contact leg and the second contact leg are formed on the contact foot, whereas, in a second variant, the first contact leg is formed on the contact foot, and the second contact leg is part of the clamping element.

In the first variant, the contact foot is of a resilient material, whereby the two contact legs form a V prior to being contacted with the current bar. After the contact foot, which includes the contact legs, has been connected to the current bar by the squeezing together of the two contact legs and the subsequent insertion of the free ends of the legs into receptive recesses or openings in the current bar, the contact legs in the clamp connection are under initial tension as a result of their spring force being exerted on the wall of the recess or opening. For purposes of accepting the two contact legs, one current bar opening can be provided for each of the free ends, or a common opening can be provided for both free ends.

In the second variant, the second contact leg extends as part of the clamping element parallel to the first leg, which is part of the contact foot, in the clamp connection to the current bar.

In either variant, the clamping element can be attached or disposed at the contact foot in different ways, the connection being either permanent or detachable. In the first variant, the clamping element is, expediently, formed at the contact foot. The clamping element is, then, a united or one-piece component of the contact foot, which makes possible a high degree of pre-production. The contact foot is, then, preferably, a metallic punched profile part.

In the second variant, the clamping element is expediently a separate part of resilient material, preferably, in the form of a steel clamping spring produced from a punch-bent part. In such a case, to guarantee precise positioning, the clamping element including the second contact leg has a recess or holding opening, through which a holding or positioning nose that is formed at the contact foot reaches when these two individual parts have been put together. In the connection to the current bar, the second contact leg—which is united with the clamping element in this variant—is under an initial tension as a result of the spring force of the clamping element that is exerted on the edge of the recess or opening facing the clamping element. The free end of the leg of the clamping element is inserted in the same current bar opening as the free end of the (first) contact leg of the contact foot.

Whereas, in the one-piece variant, the spring effect that is required for the resilient clamp connection is achieved by the two contact legs being moved in the direction of one another and contacted with the current bar during the assembling process, in the two-piece variant, the end of the clamping element near the current bar only is led in the direction of the rigid contact foot, i.e., the first contact leg. To that end, in accordance with a further feature of the invention, the, an abutment is provided at the contact foot in the form of a camber that is directed toward the clamping element. This configuration forms a bending edge for the clamping element during the compressing of the two contact legs for purposes of generating the initial tension required in the clamp connection to the current bar.

Instead of the fixing or receiving opening in the current bar for guaranteeing reliable contacting of the contact foot to the current bar, this can also have collar-type contours that, then, form the corresponding installation surfaces for the free ends of the contact legs. For a catch connection, recesses or fixing openings are, expediently, provided in the current bar, which openings are engaged on the top side of the current bar, which is averted from the contact foot, in the region of their edges by catch elements that are formed on the free ends of the contact legs. In the current bar contacting mechanism, by a catch, one contact opening (catch opening) can be provided for each contact leg, or one opening can be provided for both legs.

In either variant, the clamping element is at least partially arc-shaped or semicircular for purposes of fixing or holding the contact foot at the bearing bar with secure contact. Such a shape makes possible a reliable reach-around at the edge of the bearing bar with sufficient spring force. The arc-shaped or semicircular shape forms a clamping leg with a large clamping power at the free end of the clamping element on the bearing bar side.

With the objects of the invention in view, there is also provided a connection system, including a current bar, a contact foot, a clamping element, a bearing bar having a bearing bar edge, the clamping element extending behind the bearing bar edge and removably fixing the contact foot at the bearing bar, and the contact foot and the clamping element forming a resilient clamp removably contacting the contact foot to the current bar.

With the objects of the invention in view, the connection system is a component of a protective conductor terminal or ground conductor terminal. The connection system is inserted in the isolating housing of the protective conductor terminal and positioned there. Internally, the current bar is conductively connected to connection devices in the form of spring clamps or what are referred to as cage tension springs for the clamp contacting of ground conductors or protective conductors. For the clamp contacting, the protective conductor terminal is snapped onto the bearing bar, usually together with other series mounted devices, particularly for the phase conductors of a three-conductor or four-conductor network.

The advantages of the invention lie specifically in the ability to assemble the individual parts of the connection system easily by virtue of a resilient connection in the form of a plug, clamp, or catch connection between a current bar and a contact foot of a connection system, with or without a separate clamping or spring element. In addition, with few individual parts, a particularly high level of pre-production can be achieved for the connection system, and with it a protective conductor terminal. By developing the individual parts as plug elements, a modular connection system, particularly, for ground conductor terminals, is provided according to a unit assembly system, with which a number of different instances can be realized.

Other features that are considered as characteristic for the invention are set forth in the appended claims.

Although the invention is illustrated and described herein as embodied in a connection system, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

In the figures of the drawings, unless stated otherwise, identical reference symbols denote identical parts.

Figure 1:
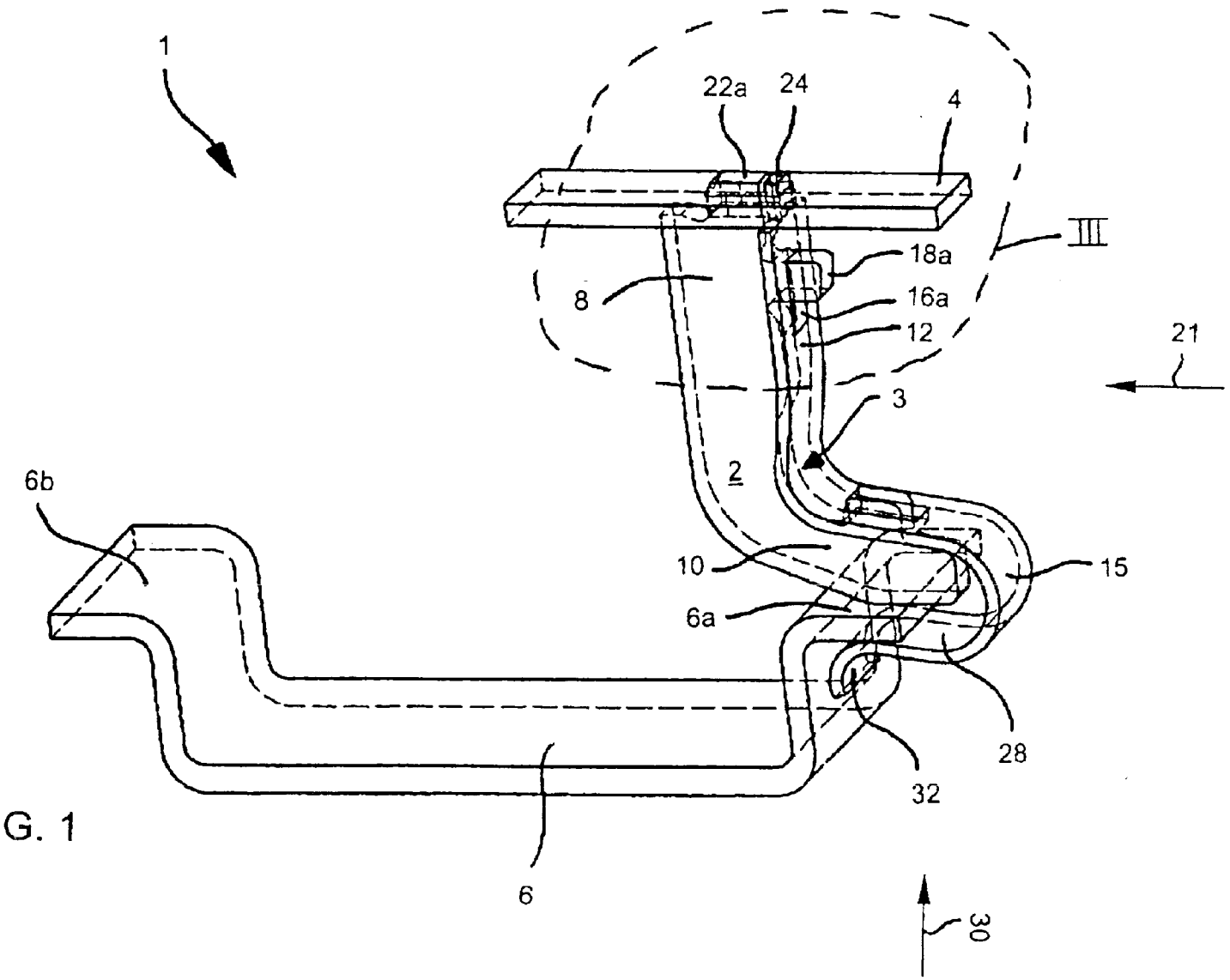
FIG. 1 is a perspective and partially hidden view of a connection system with a contact foot and a separate clamping spring according to the invention.
Figure 2:
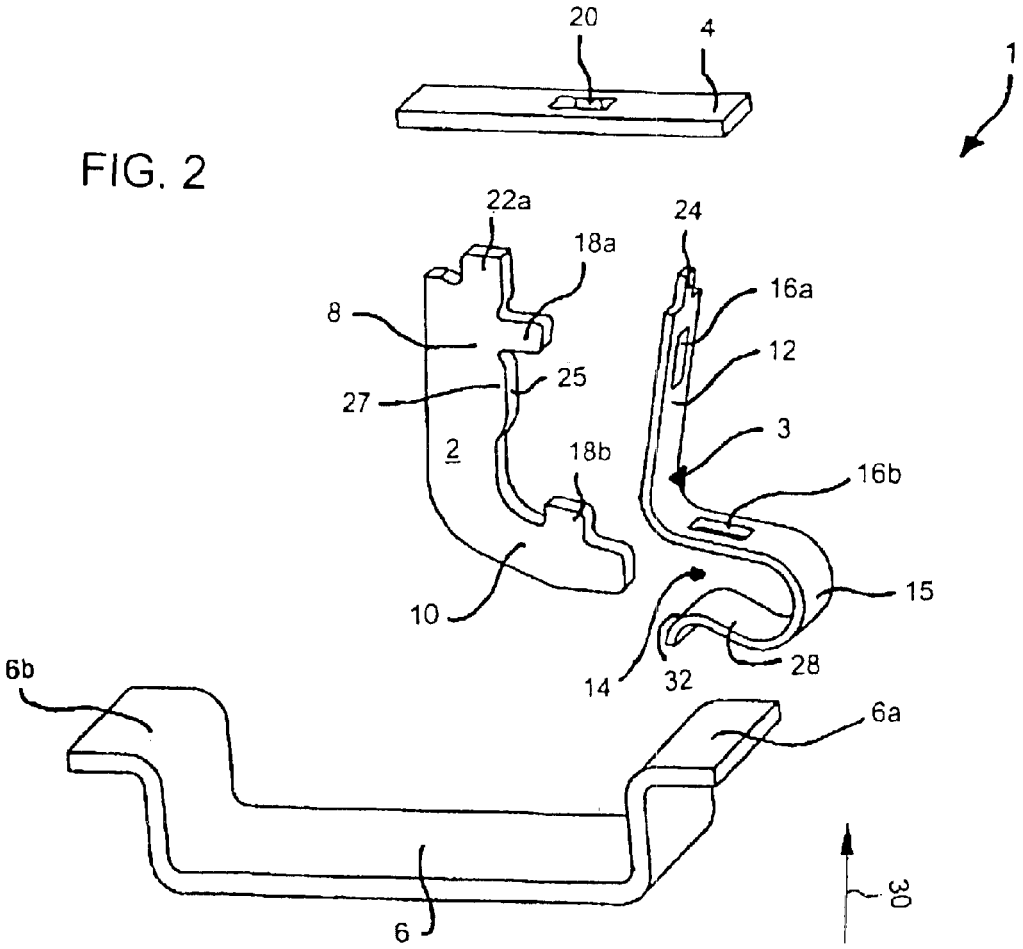
FIG. 2 is an exploded perspective view of the connection system of FIG. 1.
Figure 3:
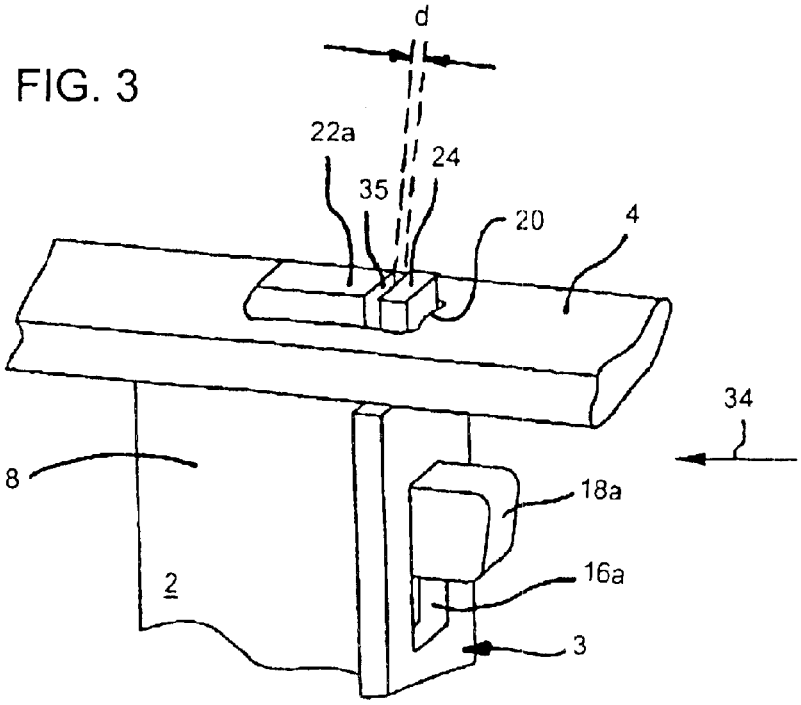
FIG. 3 is a fragmentary, enlarged, perspective view of a portion III of FIG. 1 with a resilient single-hole clamp connection in the region of the current bar.

Referring now to the figures of the drawings in detail and first, particularly to FIGS. 1 to 3 thereof, there is shown, a first two-part embodiment—previously referred to as the second variant—of the inventive connection system 1. A contact foot or attachment foot 2 and a clamping element 3 are disposed between a current bar 4 and a bearing bar 6 as separate parts. The top half of the contact foot 2, which is the side nearer the current bar, is constructed as a contact leg 8, whereas the second half, the side near the bearing bar, forms a contact nose 10. The contact foot 2 is a one-piece component, preferably, a punched part.

The clamping element 3, which is produced from a bent or rolled sheet part, is disposed at the contact foot 2. The top half of the clamping element 3, the side near the current bar, likewise, serves as contact leg 12, which is adapted to the shape and curve of the contact or attachment foot 2. In the bottom region on the bearing bar side, the clamping element 3 includes an arc-shaped or U-shaped clamping leg 15, whereby a clamp opening 14 is formed, which leg, in joining with the bearing bar 6, reaches around, and makes clamping contact with, the edge 6*a* of the bearing bar 6 and the contact nose 10, which abuts said edge, of the contact foot 2.

The clamping element 3 has a holding opening 16*a* and a positioning opening 16*b*, in the form of rectangular through-opening or recesses on the current bar side and bearing bar side. Corresponding holding noses 18*a* and 18*b* that are formed at the contact foot 2 reach through these holding openings 16*a* and 16*b*, respectively, so that the clamping element 3 is positioned and fixed in place in the assembled condition.

An expediently rectangular fixing or clamping opening 20 is located in the current bar 4. On the free end, which faces the current bar 6, of the contact leg 8 of the contact foot 2, a fixing nose 22*a* is formed, which is inserted into the clamping opening 20 together with a clamping nose 24 that is realized on the free end of the contact leg 12 of the clamping element 3. To insert the two contact legs 8 and 12 into the clamping opening 20, the contact leg 12 and, with it, the clamping nose 24, are pressed in a bending direction parallel to the bearing bar 6 and the current bar 4.

The bending, which generates initial spring tension, occurs around a bending edge 25, which is formed by a camber 27 that is formed on the contact foot 2 in the region of the leg 8 thereof. The camber 27, which is raised in the direction of the clamping element 3, thus, serves as an abutment or an abutment cam for the clamping element 3 for purposes of prestressing it when the contact leg 8 of the contact foot 2 and the contact leg 12 of the clamping element 3 are pressed together. This prestressing of the clamping element 3 guarantees a reliable resilient clamp or catch connection and, thus, a reliable contacting of the contact foot 2 to the current bar 4. The spring deflection of the clamping nose 24, and, thus, of the contact leg 12 of the clamping element 3, which deflection the resilient clamping element 3 requires for correction, is blocked by the edge of the fixing or clamping opening 20, which acts as a stop.

For fixing the contact foot 2 to the bearing bar 6, the U-shaped clamping leg 15 of the clamping element 3 forms a clamping arm 28, which is located on the bottom side of the bearing bar 6, the side averted from the contact nose 10. By swinging out during the insertion of the bearing bar edge 6*a* into the clamping element opening 14, the clamping arm 28 exerts a clamping pressure on the bearing bar edge 6*a* in the clamping pressure direction 30. To guarantee easy insertion of the bearing bar edge 6*a* into the clamping element opening 14, an incline 32 that runs opposite the clamping pressure direction 30 is formed on the clamping arm 28 at the free end thereof.

FIG. 2 represents, relatively clearly, the shapes and configurations of the contact foot 2 and the clamping element 12 in the two-part variant. The clamp contacting of the contact foot 2 at the bearing bar 6 by the separate clamping element 3 occurs only at one of the two bearing bar edges 6*a* or 6*b*, which is advantageous particularly in view of the small material requirement.

FIG. 3 is a detail representation of the clamp connection between the current bar 4 and the two clamp or contact legs 8 and 12 of the contact foot 2 and the clamping element 3 in perspective. A cushion-type inwardly bulging edge of the fixing or clamping opening 20 is evident. This achieves a precise positioning of the free ends of the legs in the form of the fixing nose 22*a* of the contact foot 2 and the clamping nose 24 of the clamping element 3, which reach through the clamping opening 20 in the clamp connection. In addition, the two clamp legs 8, 12 are led close to one another in the direction of pressure 34, forming only a small clamp gap 35, whereby the approximately linear contact leg 12 of the clamping element 3 is pressed to the contact foot 2.

Due to the camber 27 acting as an abutment cam, a certain amount of pressure is required to be able to insert the fixing nose 22*a* and the clamping nose 24 into the fixing opening 20. The clamping nose 24 exerts a clamping pressure on the fixing opening 20 by way of the spring pressure that is directed against the direction of pressure 34. This resilient clamp contact can be unmade by moving the contact leg 3 further in pressure direction 34, whereby the width d of the clamping gap 35 is reduced, and the clamping between the contact foot 2, the clamp element 12, and the current bar 4 is released.

Figure 4:
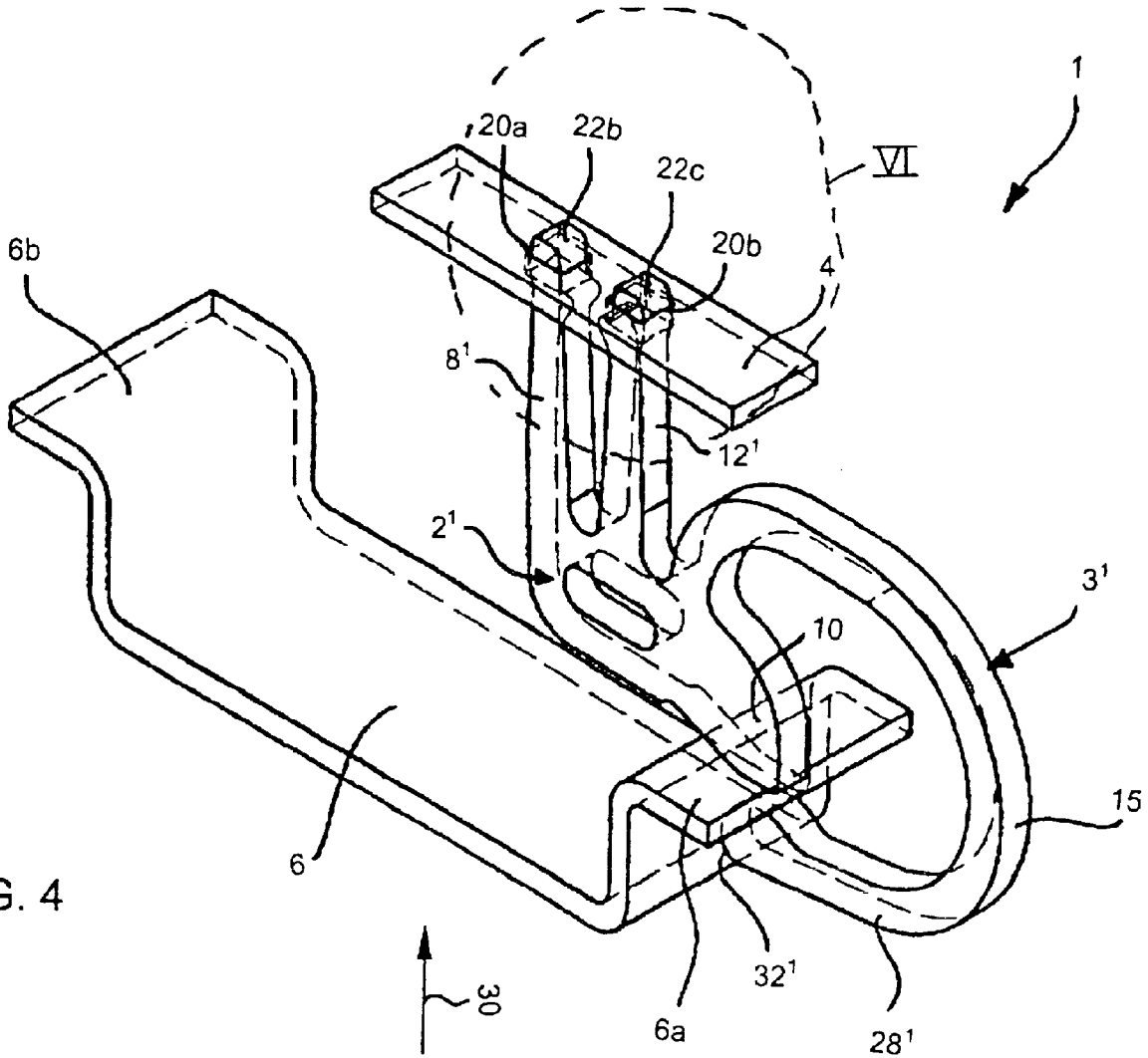
FIG. 4 is a perspective and partially hidden view of an alternative embodiment of the connection system according to the invention with a clamping element formed on the contact foot.
Figure 5:
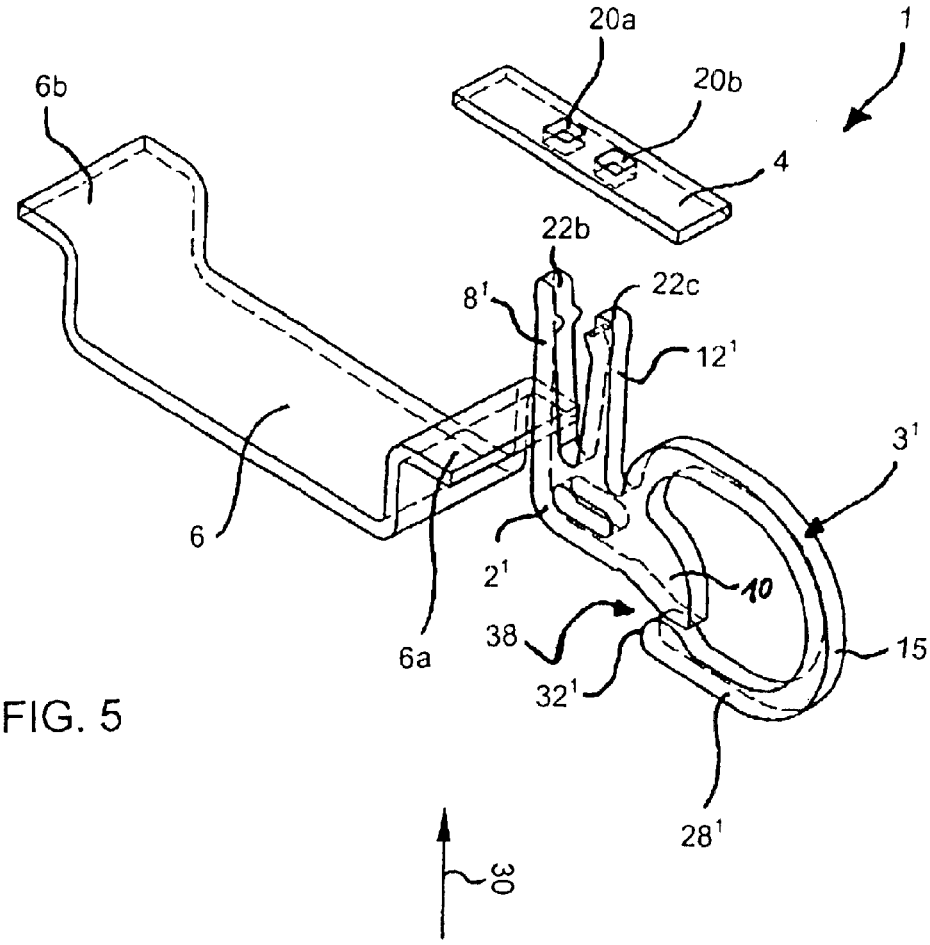
FIG. 5 is an exploded and partially hidden view of the connection system of FIG. 4.
Figure 6:
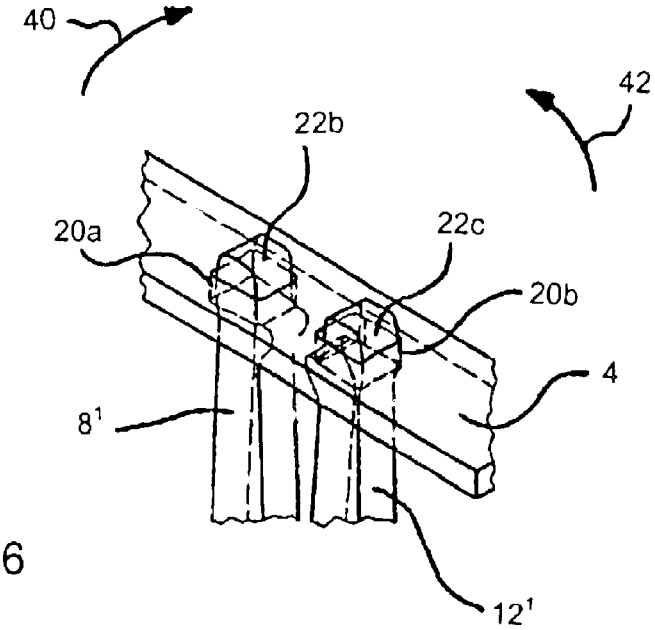
FIG. 6 is a fragmentary, enlarged, perspective view of a portion VI of FIG. 4 with a resilient two-hole clamp connection in the region of the current bar.

In the one-part embodiment of the connection system 1, which is represented in FIGS. 4 to 6 (previously referred to as the first variant), the contact foot 2' and the clamping element 3' are a one-piece or united molded part. In this variant, the clamping element 3' is formed on the contact foot 2' in the region of the contact nose 10. This unified contact-clamp element is a punched profile part, preferably, a metallic punched profile part being at least partly of a copper special alloy. In contrast to the variants according to FIGS. 1 to 3, in this variant, both the first contact leg 8' and the second contact leg 12' are formed on the contact 2'. The two contact legs 8', 12' extend substantially parallel to one another in the clamp connection shown in FIGS. 4 and 6, whereas, the contact legs 8' and 12' form an approximate V shape in the initial condition according to FIG. 5. Each of the fixing noses 22*b* and 22*c* that are formed on the first contact leg 8' and the second contact leg 12' reaches through a respective fixing opening 20*a* or 20*b* in the current bar 4.

The clamping element 3' that is formed on the contact foot 2', in turn, forms an arc-shaped or U-shaped clamping leg 15, which, likewise, has an inclination 32' on the free end for inserting the bearing bar edge 6*a*. The clamping element 3', in turn, exerts a clamping force in the clamping direction 30 upon the bearing bar edge 6*a*, which, analogously to the variant according to FIGS. 1 to 3, also lies between the contact nose 10 of the contact foot 2' and the clamping arm 28' of the clamping element 3' in the clamp or catch connection, with the effect that an isolating housing, which accepts the connection system 1, of a protective conductor terminal (not represented in detail) is held on or at the bearing bar 6 in a reliable but detachable fashion. For this reason, the clamping element 3' exhibits the requisite resilient characteristics based on its arch-shape.

FIG. 5 represents an insertion gap 38 between the free end of the clamping arm 28' of the clamping element 3' and the contact nose 10 of the contact foot 2', whereby, this insertion gap 38 is smaller than the profile thickness of the bearing bar edge 6*a*. With the insertion or pushing of the bearing bar edge 6*a* along the inclination 32' into the gap 38, the gap 38 is enlarged or widened under the initial tension of the clamping element 3'. In turn, the clamping arm 28 exerts the requisite holding or fixing pressure on the bearing bar edge 6*a* in clamping pressure direction 30 based on its resilience. The contact nose 10 of the contact foot 2' serves as abutment therein.

FIG. 6 represents a detail view of the resilient clamp connection that is formed in this variant between the two contact legs 8', 12' of the contact foot 2' and the current bar 4. The clamp contact is achieved by way of the two fixing noses 22*b* and 22*c* that are formed at the contact legs 8', 12'. For purposes of penetrating the two fixing openings 20*a* and 20*b*, the two contact legs 8', 12', which form a V in their resting position, are moved toward one another with their fixing noses 22*b* and 22*c*, whereby, the two fixing noses 22*b* and 22*c* are pressed in bending directions 40 and 42, respectively. The pressure of the two contact legs 8' and 12' to correct themselves against their respective bending directions 40 and 42 gives rise to the resilient clamp contact between the contact foot 2' and the current bar 4. In the clamp connection, the two contact legs 8' and 2' are parallel to one another.

Such a resilient clamp contact can also be unmade by moving the two contact legs 8' or 12' in their respective bending directions 40, 42 until the contact between the fixing noses 22*b*, 22*c* and the corresponding fixing openings 20*a* and 20*b* is lost. The two contact legs 8' and 12' can, then, be withdrawn from the corresponding fixing openings 20*a* and 20*b*, whereby the clamping between the contact foot 2' and the current bar 4 is released.

I claim:

1. A connection system, comprising:

a current bar;

a bearing bar having a bearing bar edge;

a contact foot having a first contact leg, said contact foot being contacted at said current bar in a resilient clamp connection;

a clamping element being separate from said contact foot and having a second contact leg, said clamping element extending behind said bearing bar edge and removably fixing said contact foot at said bearing bar; and one of said first and second contact legs serving as an abutment for and resiliently prestressing the other of said first and second contact legs in said resilient clamp connection with said current bar.

2. The connection system according to claim 1, wherein said second contact leg is at least approximately parallel to said first contact leg.

3. The connection system according to claim 1, wherein:

said clamping element has at least one holding opening; and said contact foot has a holding nose extending through said at least one holding opening.

4. The connection system according to claim 1, wherein said contact foot has a camber raised toward said clamping element and forming an abutment for said second contact leg.

5. The connection system according to claim 1, wherein said clamping element has a clamping region allocated to said bearing bar edge and is arch-shaped in said clamping region.

6. A connection system, comprising:

a current bar;

a bearing bar having a bearing bar edge;

a contact foot having a first contact leg and a second contact leg formed thereon, said contact foot being contacted at said current bar in a resilient clamp connection, and one of said first and second contact legs being deflected towards and resiliently prestressing the other of said first and second contact legs in said resilient clamp connection with said current bar; and a clamping element formed on said contact foot, extending behind said bearing bar edge and removably fixing said contact foot at said bearing bar.

7. The connection system according to claim 6, wherein:

said first and second contact legs have free ends, and said current bar has at least one opening for receiving said free ends.

8. The connection system according to claim 6, wherein said first and second contact legs are disposed in a V shape.

9. The connection system according to claim 6, wherein said clamping element has a clamping region allocated to said bearing bar edge and is arch-shaped in said clamping region.

10. A protective conductor terminal, comprising:

a current bar;

a bearing bar having a bearing bar edge;

a contact foot having a first contact leg, said contact foot being contacted at said current bar in a resilient clamp connection;

a clamping element being separate from said contact foot and having a second contact leg, said clamping element extending behind said bearing bar edge and removably fixing said contact foot at said bearing bar; and one of said first and second contact legs serving as an abutment for and resiliently prestressing the other of said first and second contact legs in said resilient clamp connection with said current bar.

11. A protective conductor terminal, comprising:

a current bar;

a bearing bar having a bearing bar edge;

a contact foot having a first contact leg and a second contact leg formed thereon, said contact foot being contacted at said current bar in a resilient clamp connection, and one of said first and second contact legs being deflected towards and resiliently prestressing the other of said first and second contact legs in said resilient clamp connection with said current bar; and a clamping element formed on said contact foot, extending behind said bearing bar edge and removably fixing said contact foot at said bearing bar.

* * * * *